US009651899B2

(12) United States Patent
Makinodan

(10) Patent No.: US 9,651,899 B2
(45) Date of Patent: May 16, 2017

(54) IMAGE FORMING APPARATUS WITH BELT STEERING APPARATUS

(71) Applicant: CANON KABUSHIKI KAISHA, Tokyo (JP)

(72) Inventor: Jiro Makinodan, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/659,301

(22) Filed: Mar. 16, 2015

(65) Prior Publication Data

US 2015/0261142 A1 Sep. 17, 2015

(30) Foreign Application Priority Data

Mar. 17, 2014 (JP) ..... 2014-053229

(51) Int. Cl.
*G03G 15/00* (2006.01)
*G03G 15/16* (2006.01)

(52) U.S. Cl.
CPC ..... *G03G 15/1615* (2013.01); *G03G 15/161* (2013.01)

(58) Field of Classification Search
CPC ..... G03G 15/6115; G03G 15/1605; G03G 15/161; G03G 2215/00059; G03G 2215/00156; G03G 15/1615; G03G 2215/00143
USPC ..... 399/303, 302, 313
See application file for complete search history.

(56) References Cited

U.S. PATENT DOCUMENTS

2009/0142083 A1* 6/2009 Minbu ..... G03G 15/6594 399/45
2012/0321328 A1* 12/2012 Nakazato ..... G03G 15/1615 399/18
2013/0016996 A1* 1/2013 Yuasa ..... G03G 15/0189 399/121
2013/0039679 A1* 2/2013 Nakaegawa ..... G03G 15/1615 399/297

FOREIGN PATENT DOCUMENTS

JP H09-169449 A 6/1997
JP 2001-146335 A 5/2001
JP 2001-520611 A 10/2001
JP 2002-091185 A 3/2002
JP 2010-145939 A 7/2010
JP 2010-230817 A 10/2010

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

A steering roller autonomously steers an intermediate transfer belt. A pre-secondary-transfer roller is disposed at a position upstream of and adjacent to a driving roller also functioning as a transfer inner roller, and includes a rubber material on at least a surface thereof. This suppresses movement of the intermediate transfer belt even when a lateral-deviation converging position is changed by the change of position of the driving roller having large frictional force due to the pressing force of a secondary transfer roller. Hence, the belt deviation amount is reduced, and the time until lateral deviation converges is shortened.

5 Claims, 11 Drawing Sheets

IMAGE FORMING APPARATUS WITH BELT STEERING APPARATUS

BACKGROUND OF THE INVENTION

Field of the Invention

The present invention relates to an image forming apparatus including a belt member to be driven.

Description of the Related Art

There has been widely used an image forming apparatus including a belt conveying device in which a belt member to be driven by a driving roller is steered by a steering roller. An example of a belt conveying device is an intermediate transfer belt on which a toner image born on an image-bearing member is transferred at a primary transfer portion and which conveys the toner image to a secondary transfer portion to transfer the toner image onto a recording medium.

Various steering methods for the belt conveying device have been put to practical use.

Japanese Patent Laid-Open No. 9-169449 describes a belt conveying device of a forced steering type in which the lateral position of a belt member is detected with a sensor and a steering roller is tilted by operating an actuator and a motor. Japanese Patent Laid-Open No. 2001-146335 describes a belt conveying device of a steering type in which a steering roller biased at both ends by spring members tilts in an abutting direction according to the lateral position of a belt member.

PCT Japanese Translation Patent Publication No. 2001-520611 describes a belt conveying device of an autonomous steering type in which a steering roller turnably supported at a center portion in the rotation axis direction autonomously tilts according to the torque balance of the frictional force corresponding to the lateral position of a belt member.

SUMMARY OF THE INVENTION

An image forming apparatus according to an aspect of the present invention includes a moving endless belt, a toner-image forming unit configured to form a toner image on the belt, a driving roller configured to stretch the belt and to apply driving force to the belt, a transfer roller disposed at a position opposed to the driving roller with the belt being disposed therebetween and configured to form a transfer portion where the toner image formed on the belt is transferred onto a recording medium, a steering roller disposed downstream of the driving roller and upstream of the toner-image forming unit in a moving direction of the belt and configured to stretch the belt and to tilt to adjust a position of the belt in a widthwise direction intersecting the moving direction of the belt, and a driven roller disposed downstream of the toner-image forming unit and upstream of the driving roller in the moving direction of the belt, having a rubber material at least on a surface thereof, and configured to stretch the belt and to rotate along with movement of the belt.

Further features of the present invention will become apparent from the following description of exemplary embodiments with reference to the attached drawings.

DESCRIPTION OF THE EMBODIMENTS

An embodiment of the present invention will be described in detail below with reference to the drawings.

Image Forming Apparatus

Figure 1:
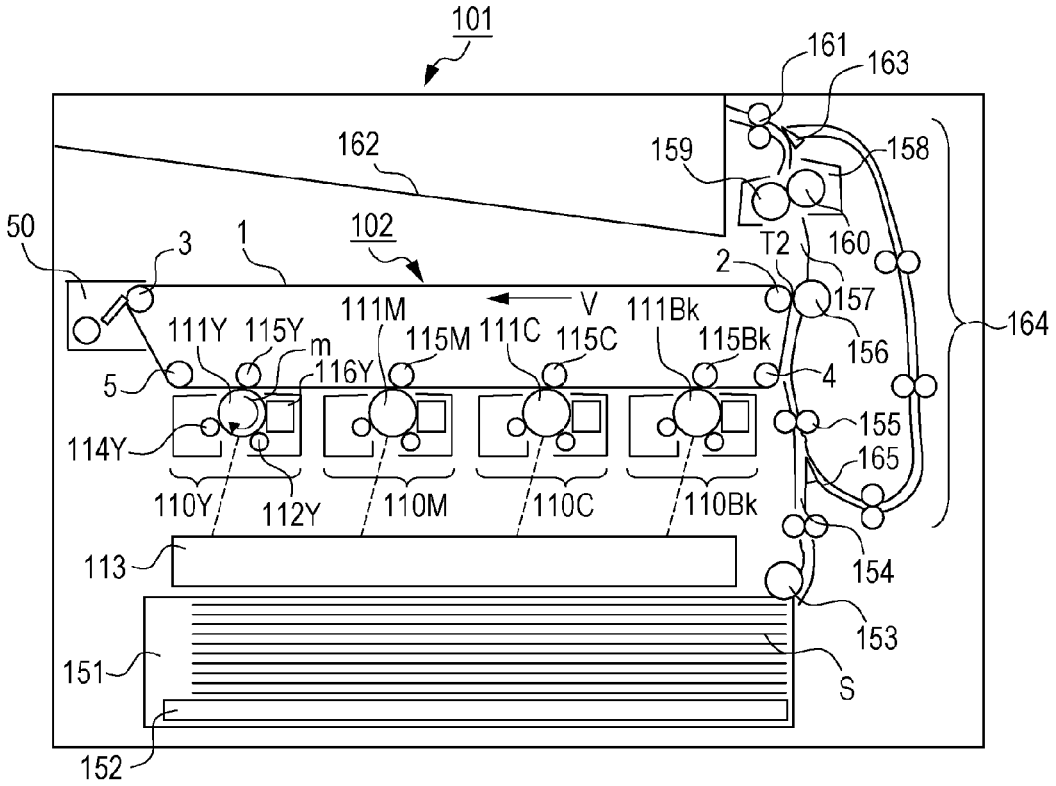
FIG. 1 is an explanatory view illustrating the configuration of an image forming apparatus.

FIG. 1 is an explanatory view illustrating the configuration of an image forming apparatus. As illustrated in FIG. 1, an image forming apparatus 101 is a full-color printer of a tandem intermediate transfer system in which image forming units 110 (110Y, 110M, 110C, and 110Bk) in the form of process cartridges are arranged along a downward surface of an intermediate transfer belt 1.

In the image forming unit 110Y, a yellow toner image is formed on a photoconductive drum 111Y, and is transferred onto the intermediate transfer belt 1. In the image forming unit 110M, a magenta toner image is formed on a photoconductive drum 111M, and is transferred onto the intermediate transfer belt 1. In the image forming units 110C and 110Bk, a cyan toner image and a black toner image are formed on photoconductive drums 111C and 111BK, respectively, and are transferred onto the intermediate transfer belt 1.

The toner images of four colors transferred on the intermediate transfer belt 1 are conveyed to a secondary transfer portion T2, and are secondarily transferred onto a recording medium S. Recording media S are stacked on a lifting-up unit 152 in a recording-medium container 151. A separation roller 153 separates the uppermost recording media S on the lifting-up unit 152 one by one, and feeds out a separated recording medium S to registration rollers 155. The registration rollers 155 send the recording medium S into the secondary transfer portion T2 in timing to the toner images on the intermediate transfer belt 1.

A secondary transfer roller 156 is in contact with the intermediate transfer belt 1, whose inner surface is supported by a driving roller 2, to form the secondary transfer portion T2. The toner images on the intermediate transfer belt 1 are secondarily transferred onto the recording medium S by applying positive direct-current voltage to the secondary transfer roller 156.

After the toner images of four colors are secondarily transferred on the recording medium S, the recording medium S is heated and pressed in a fixing device 158 so that the toner images are fixed on a surface of the recording medium S. The fixing device 158 melts and fixes the toner images on the recording medium S by applying a predetermined pressing force and a predetermined quantity of heat at a nip defined by a fixing roller 159 and a pressing roller 160. The fixing roller 159 contains a heater serving as a heat source therein. The pressing roller 160 is urged against the fixing roller 159.

A belt cleaning device 50 collects transfer residual toner on the surface of the intermediate transfer belt 1 by frictionally sliding a cleaning blade on the intermediate transfer belt 1.

In one-sided printing, the recording medium S passed through the fixing device 158 and conveyed to sheet discharge reversing rollers 161 is discharged onto a sheet discharge tray 162 as it is. In contrast, in double-sided printing, the recording medium S is switched back by the sheet discharge reversing rollers 161 to change places between leading and trailing edges thereof, and is then conveyed to a double-sided conveying device 164. After that, the recording medium S joins a feeding and conveying path 154 from a refeeding path 165 in timing to a succeeding recording medium conveyed from the separation roller 153, and is conveyed to the secondary transfer portion T2. Since an image forming process for a back surface (second surface) is similar to the above-described image forming process for the front surface (first surface), a description thereof is skipped.

Image Forming Units

The image forming units 110Y, 110M, 110C, and 110Bk have almost the same structure except that they use toners of different colors of yellow, magenta, cyan, and black, respectively, in developing devices 114. The image forming unit 110Y will be described below, and redundant descriptions of the other image forming units 110M, 110C, and 110Bk are skipped.

In the image forming unit 110Y, a charging device 112Y, an exposure device 113, a developing device 114Y, a primary transfer roller 115Y, and a drum cleaning device 116Y are arranged around a photoconductive drum 111Y. The photoconductive drum 111Y is obtained by forming a photoconductive layer on an outer peripheral surface of an aluminum cylinder, and rotates at a predetermined process speed.

The charging device 112Y charges the photoconductive drum 111Y with a uniform negative potential. The exposure device 113Y writes an electrostatic image of an image on a surface of the photoconductive drum 111Y. The developing device 114Y develops the electrostatic image into a toner image by transferring toner onto the photoconductive drum 111Y.

The primary transfer roller 115Y presses the intermediate transfer belt 1 to form a primary transfer portion between the photoconductive drum 111Y and the intermediate transfer belt 1. When positive direct-current voltage is applied to the primary transfer roller 115Y, the negative toner image born on the photoconductive drum 111Y is transferred onto the intermediate transfer belt 1. The drum cleaning device 116Y removes transfer residual toner attached to the surface of the photoconductive drum 111Y by frictionally sliding the cleaning blade on the photoconductive drum 111Y.

Intermediate Transfer Unit

Figure 2:
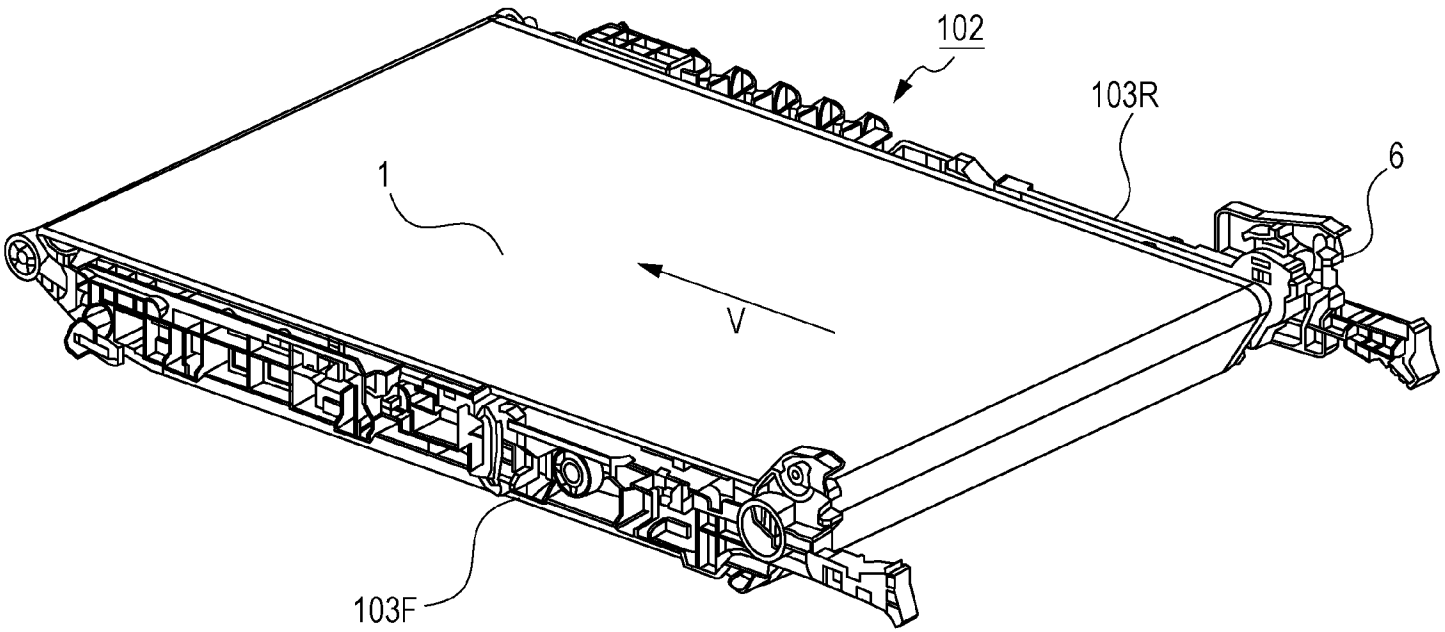
FIG. 2 is an explanatory view illustrating the structure of an intermediate transfer unit.
Figure 3:
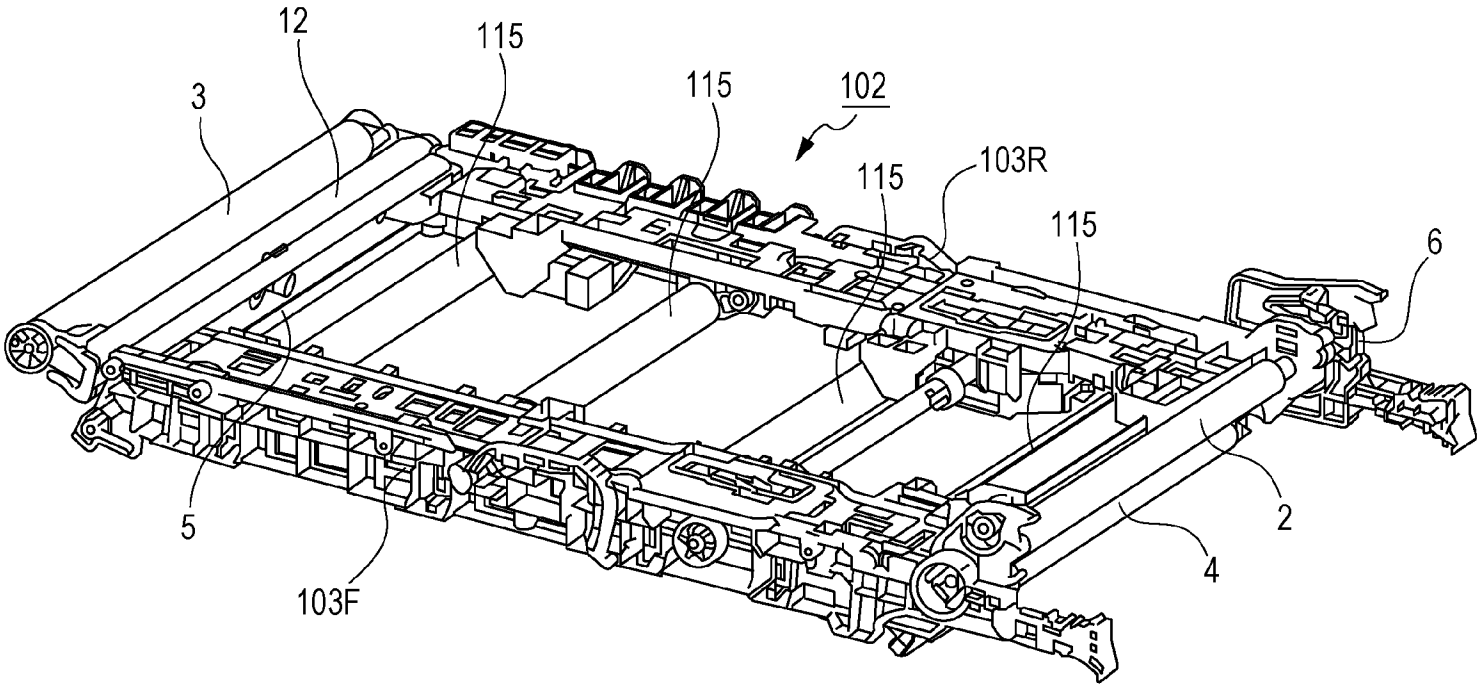
FIG. 3 is an explanatory view of a stretching mechanism for an intermediate transfer belt.

FIG. 2 is an explanatory view illustrating the structure of an intermediate transfer unit. FIG. 3 is an explanatory view of a stretching mechanism of the intermediate transfer belt.

As illustrated in FIG. 2, an intermediate transfer unit 102 is a replaceable unit such that the intermediate transfer belt 1 and a support mechanism therefor are drawn out from the image forming units 101 (FIG. 1) and are integrally replaced. The intermediate transfer unit 102 is assembled by stretching the intermediate transfer belt 1 by a plurality of rollers laid between a unit rear side plate 103R and a unit front side plate 103F. The intermediate transfer belt 1 is conveyed in a direction of arrow V by conveying force of the driving roller 2 input from a driving coupling 6.

As illustrated in FIG. 3, the intermediate transfer belt 1 is stretched by a steering roller 3 also functioning as a tension roller, a driving roller 2 also functioning as a secondary-transfer counter roller, a pre-secondary-transfer roller 4, and a post-steering roller 5. Herein, the term "stretch" means that the rollers support the outline of the intermediate transfer belt 1 while being in contact with the intermediate transfer belt 1 at winding angles. Although four primary transfer rollers 115 are disposed between the post-steering roller 5 and the pre-secondary-transfer roller 4, they do not stretch the intermediate transfer belt 1.

The steering roller 3, the pre-secondary-transfer roller 4, and the post-steering roller 5 are not driven, but rotate along with conveyance of the intermediate transfer belt 1. The pre-secondary-transfer roller 4 is disposed upstream of the driving roller 2 in the conveying direction of the intermediate transfer belt 1. The steering roller 3 is disposed downstream of the driving roller 2. The post-steering roller 5 is disposed downstream of the steering roller 3.

An outer peripheral portion of the driving roller 2 is formed of a conductive EPDM rubber material. This is because the driving roller 2 exerts a sufficient frictional force to convey the intermediate transfer belt 1 in a state in which tensile force is applied from the tension roller (steering roller 3) to the intermediate transfer belt 1. An initial static friction coefficient $\mu$ of the outer peripheral surface of the driving roller 2 is 1.0 to 1.5.

The distance from the pre-secondary-transfer roller 4 to the driving roller 2 along the intermediate transfer belt 1 is shorter than the distance from the driving roller 2 to the steering roller 3. Hence, the driving roller 2 and the pre-secondary-transfer roller 4 define a short belt surface along which a recording medium S enters the secondary transfer portion T2. For this reason, the recording medium S stably enters the secondary transfer portion T2, and image defects are reduced. Further, since the steering roller 3 is located at a position remote from the driving roller 2, twisting of the belt surface resulting from the tilt of the steering roller is unlikely to affect the recording medium S passing through the secondary transfer portion T2.

As described above, the driving roller 2 stretches and drives the intermediate transfer belt 1 serving as an example of an endless belt member. The steering roller 3 stretches and steers the intermediate transfer belt 1. The pre-secondary-transfer roller 4 serving as an example of a driven roller stretches the intermediate transfer belt 1 and rotates along with the rotation of the intermediate transfer belt 1 on the downstream side of the steering roller 3 and the upstream side of the driving roller 2 in the rotating direction of the intermediate transfer belt 1. The secondary transfer roller 156 is in pressure contact with the driving roller 2 with the intermediate transfer belt 1 being disposed therebetween. The driving roller 2 also functions as a secondary-transfer inner roller for transferring a toner image born on the intermediate transfer belt 1 onto a recording medium S.

Attachment and Detachment Operation of Intermediate Transfer Belt

Figure 4A:
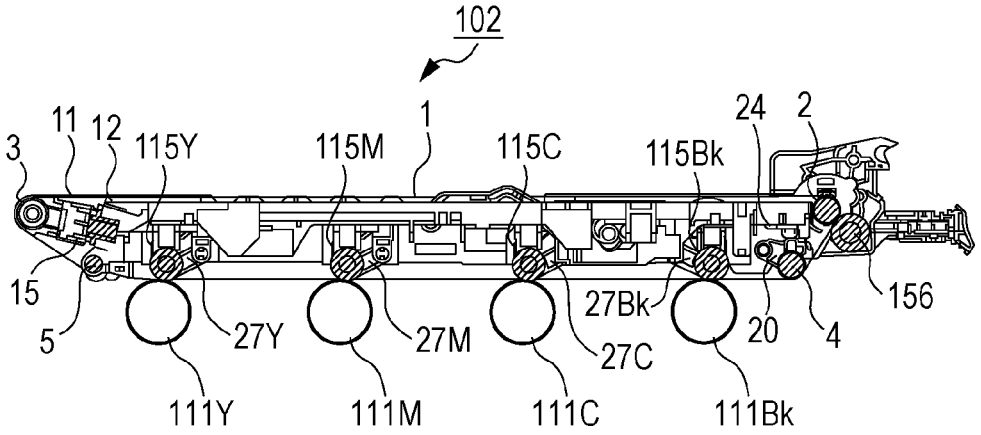
FIGS. 4A and 4B are explanatory views illustrating a state in which the intermediate transfer belt is in contact with photoconductive drums.
Figure 4B:
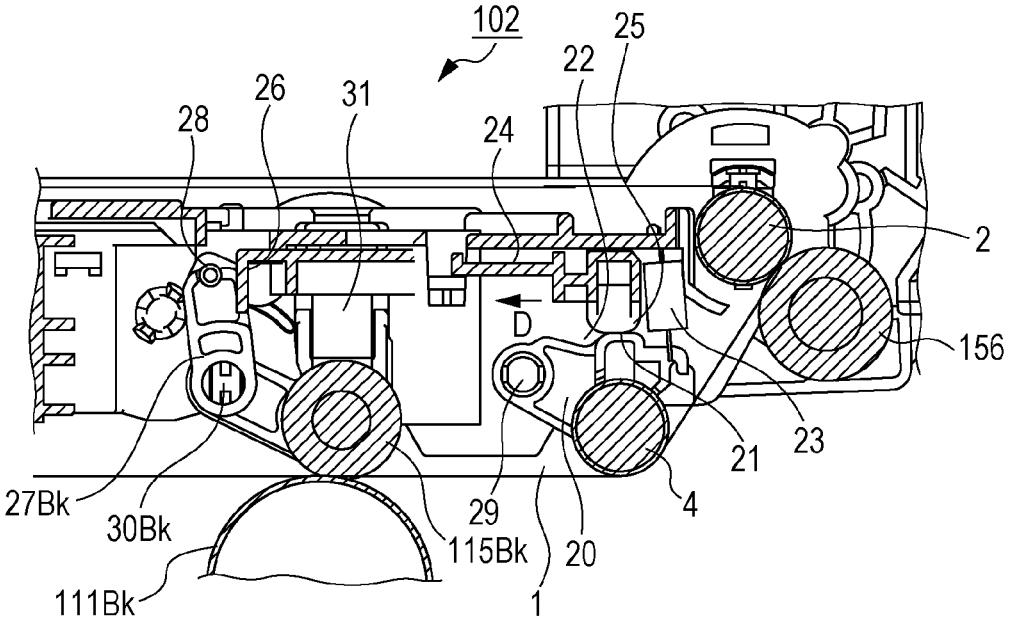
Figure 5A:
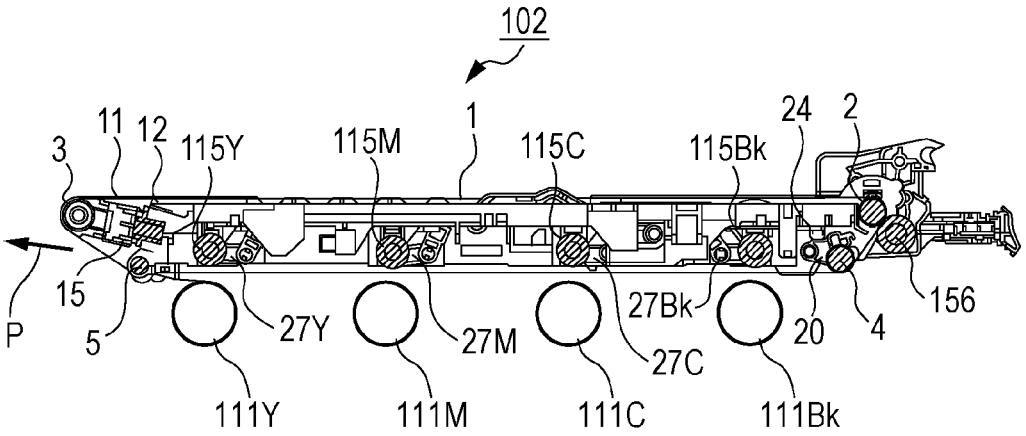
FIGS. 5A and 5B are explanatory views illustrating a state in which the intermediate transfer belt is separate from the photoconductive drums.
Figure 5B:
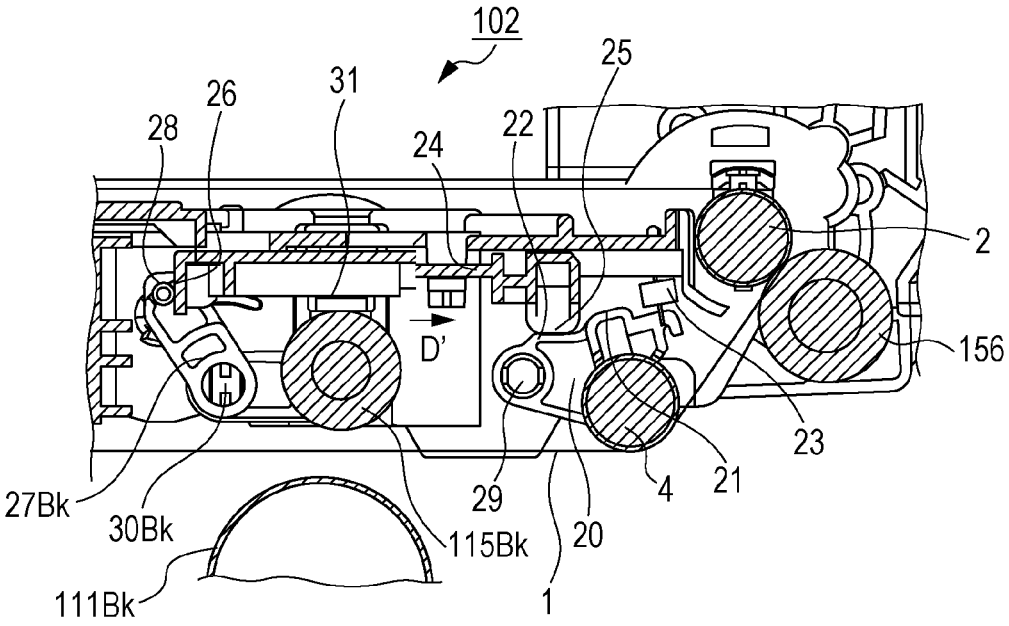

FIGS. 4A and 4B are explanatory views illustrating a state in which the intermediate transfer belt 1 is in contact with the photoconductive drums 111 (111Y, 111M, 111C, and 111Bk). FIGS. 5A and 5B are explanatory views illustrating a state in which the intermediate transfer belt 1 is separate from the photoconductive drums 111. FIGS. 4A and 5A are overall views, and FIGS. 4B and 5B are enlarged views of a portion near the secondary transfer portion T2.

As illustrated in FIG. 4A, the intermediate transfer unit 102 integrally lifts and lowers the primary transfer rollers 115, the pre-secondary-transfer roller 4, and the post-steering roller 5 to bring the intermediate transfer belt 1 into and out of contact with the photoconductive drums 111.

When the image forming apparatus 101 forms an image, the primary transfer rollers 115, the pre-secondary-transfer roller 4, and the post-steering roller 5 are lowered to bring the intermediate transfer belt 1 into contact with the photoconductive drums 111. During image formation, the intermediate transfer belt 1 is pressed against the photoconductive drums 111.

As illustrated in FIG. 4B, pre-secondary-transfer roller bearings 20 support the pre-secondary-transfer roller 4 rotatably. The pre-secondary-transfer roller bearings 20 are turnably supported by bearing turning shafts 29 provided in the unit rear side plate 103R and the unit front side plate 103F, and are biased in the counterclockwise direction by tension springs 23.

Separation sliders 24 are driven by unillustrated separation cams to be movable in a direction of arrow D. While the separation sliders 24 are moving rightward, abutting contact portions 21 of the pre-secondary-transfer roller bearings 20 come into contact with bearing push portions 25 of the separation sliders 24, position the pre-secondary-transfer roller 4 downward, and bring the intermediate transfer belt 1 into contact with the photoconductive drums 111.

Push bosses 28 of separation arms 27Bk are turnably supported by arm turn shafts 30Bk provided in the unit rear side plate 103R and the unit front side plate 103F illustrated in FIG. 3. The primary transfer roller 115Bk is biased downward by compression springs 31. While the separation sliders 24 are moving rightward, the push bosses 28 of the separation arms 27Bk are separate from arm push portions 26. Hence, the primary transfer roller 115Bk moves downward without being influenced by the separation arms 27Bk. The primary transfer roller 115Bk is biased by the compression springs 31, and is in contact with the photoconductive drum 111Bk with the intermediate transfer belt 1 being disposed therebetween. The other primary transfer rollers 115Y, 115M, and 115C illustrated in FIG. 4A are similarly moved to positions in contact with the corresponding photoconductive drums 111.

As illustrated in FIG. 5A, in the intermediate transfer unit 102, when the pre-secondary-transfer roller 4 and the primary transfer rollers 115 are lifted into a state separate from the photoconductive drums 111, the intermediate transfer belt 1 separates from the photoconductive drums 111. The intermediate transfer belt 1 of the intermediate transfer unit 102 is separated from the photoconductive drums 111, for example, in a main-body standby state ready for image formation, during a period when image formation is not performed, when the intermediate transfer unit 102 or the process cartridge is detached for maintenance, and during the startup time.

As illustrated in FIG. 5B, since the separation sliders 24 are driven and moved to the left by the unillustrated separation cams, separation contact portions 22 of the pre-secondary-transfer roller bearings 20 are in contact with the bearing push portions 25 of the separation sliders 24. Since the separation contact portions 22 are lower than the abutting contact portions 21, the pre-secondary-transfer roller 4 is located on the upper side to separate the intermediate transfer belt 1 from the photoconductive drums 111.

Since the separation sliders 24 are moved to the left, the push bosses 28 of the separation arms 27Bk are pushed leftward by the arm push portions 26, and the separation arms 27Bk turn in the counterclockwise direction. Thus, the primary transfer roller 115Bk is lifted to a position separate from the intermediate transfer belt 1. The other primary transfer rollers 115Y, 115M, and 115C illustrated in FIG. 5A are similarly lifted to separate from the intermediate transfer belt 1.

While the intermediate transfer belt 1 is moved into/out of contact with all the photoconductive drums 111 in the first embodiment, it does not always need to be moved into/out of contact with all the photoconductive drums 111. For example, an embodiment may be adopted so that the intermediate transfer belt 1 is always in contact with the photoconductive drum 111Bk and separate from the other photoconductive drums 111Y, 111M, and 111C.

Incidentally, when the intermediate transfer belt 1 is moved into/out of contact with the photoconductive drums 111, great disturbance is applied to driving load of the driving roller 2, and the intermediate transfer belt 1 laterally deviates. In the intermediate transfer unit 102, great frictional force acts on the driving roller 2 and this affects the inclination of the driving roller 2. When the intermediate transfer belt 1 is moved into/out of contact with the photoconductive drums 111, the frictional force acting on the driving roller 2 changes, the inclination of the driving roller 2 changes, and the intermediate transfer belt 1 deviates laterally. At this time, if the amount of lateral deviation is large, it takes much time until the lateral deviation converges.

Figure 10:
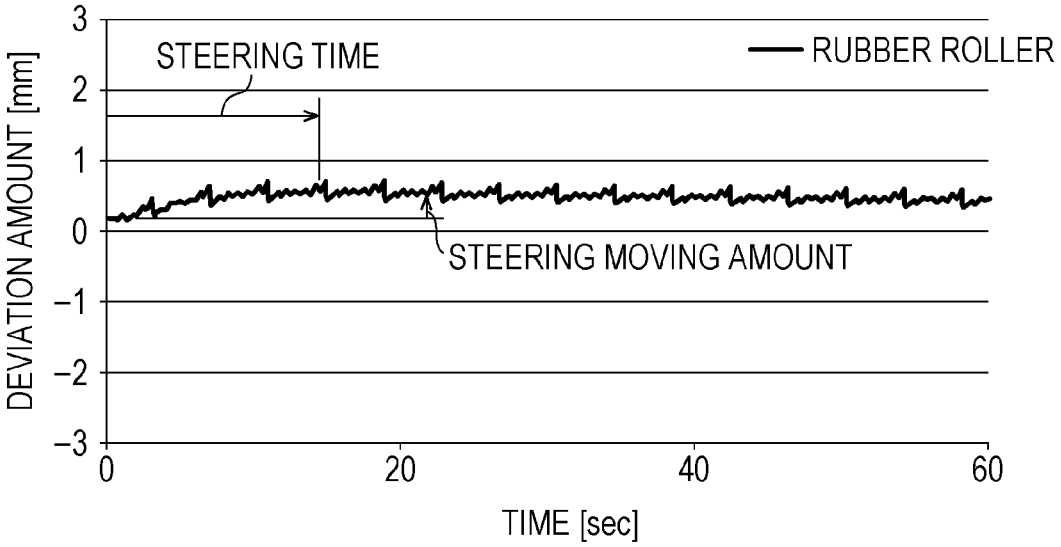
FIG. 10 is an explanatory view showing the lateral-deviation converging time of a pre-secondary-transfer roller in an example.

Accordingly, in the first embodiment, the pre-secondary-transfer roller 4 coated with a rubber material is disposed upstream of the driving roller 2 to reduce the amount of lateral deviation and to shorten the time until lateral deviation converges, as illustrated in FIG. 10.

As described above, the photoconductive drums 111 serving as an example of a rotating member and an image bearing member are disposed downstream of the steering roller 3 and upstream of the pre-secondary-transfer roller 4 in the rotating direction of the intermediate transfer belt 1 to be brought into and out of contact with the intermediate transfer belt 1. The separation sliders 24 serving as an example of a contact and separation mechanism bring the intermediate transfer belt 1 and the photoconductive drums 111 into and out of contact with each other.

Steering Mechanism

Figure 6A:
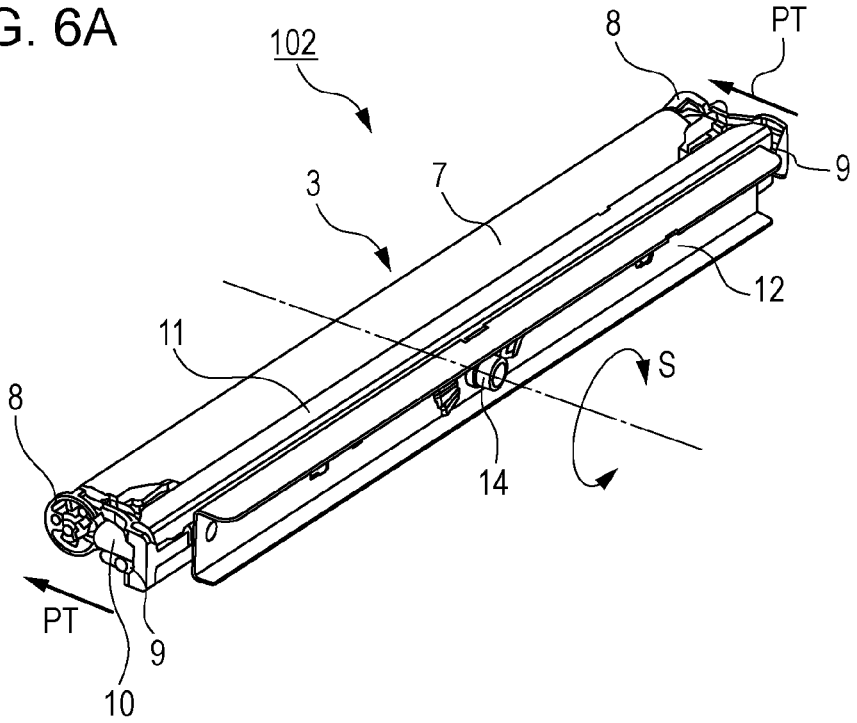
FIGS. 6A and 6B are perspective views of a steering mechanism.
Figure 6B:
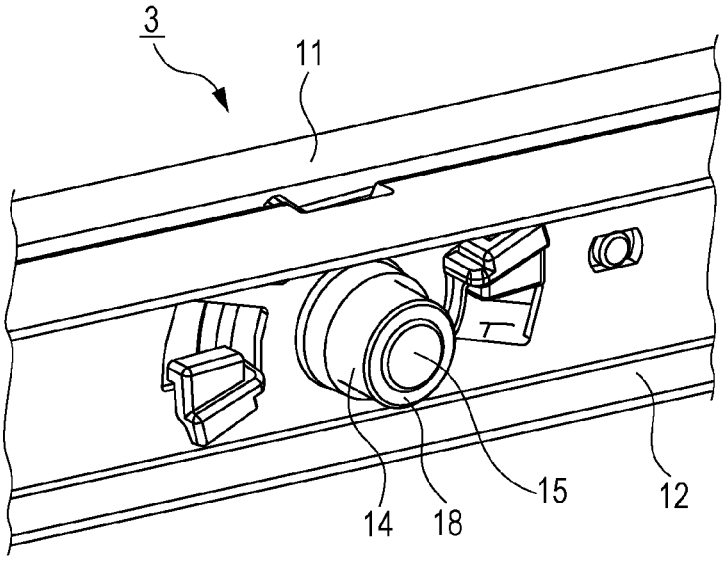
Figure 7:
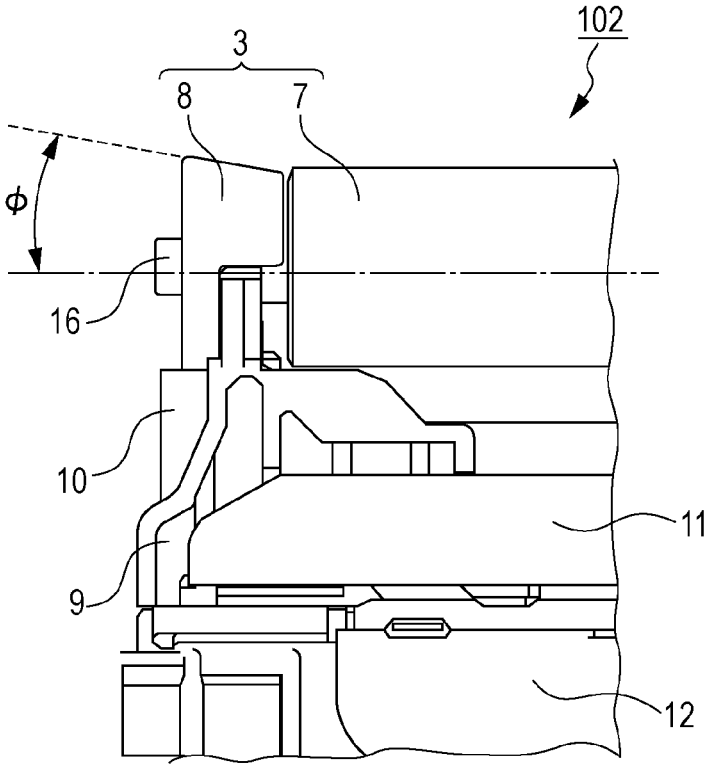
FIG. 7 is an explanatory view illustrating the structure of an end portion of a steering roller.
Figure 8A:
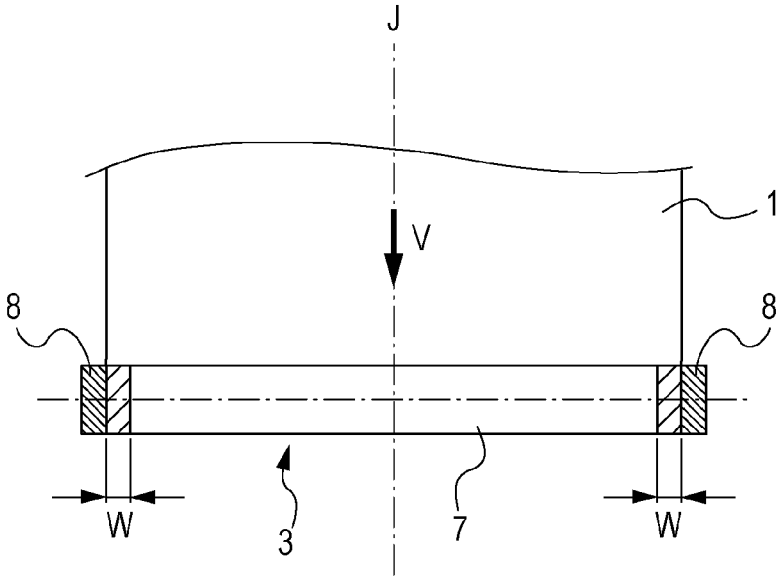
FIGS. 8A and 8B are explanatory views illustrating the positions of friction rings of the steering roller.
Figure 8B:
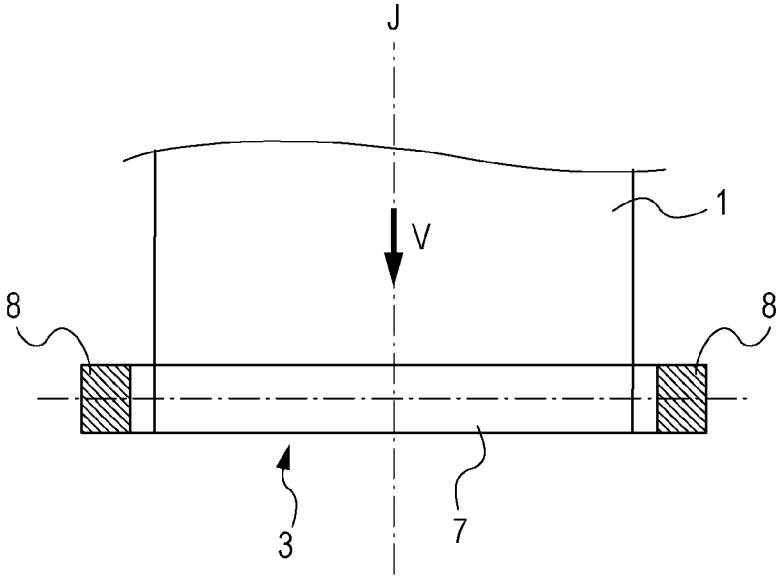

FIGS. 6A and 6B are perspective views of a steering mechanism. FIG. 7 is an explanatory view illustrating the structure of an end portion of the steering roller. FIGS. 8A and 8B are explanatory views illustrating the positions of friction rings of the steering roller. FIGS. 6A and 6B are an overall view and an explanatory view of a rotation center portion, respectively. FIGS. 8A and 8B illustrate an example and a comparative example, respectively.

As illustrated in FIG. 3, the intermediate transfer unit 102 adopts a steering mechanism of an autonomous steering type in which the steering roller 3 autonomously tilts according to the balance of the frictional force between both ends in the rotation axis direction so that lateral deviation of the intermediate transfer belt 1 converges. In the steering mechanism of the autonomous steering type, an actuator for tilting the steering roller is unnecessary.

As illustrated in FIG. 6A, a center portion of the steering roller 3 in the rotation axis direction is a driven roller 7 that rotates along with the rotation of the intermediate transfer belt 1. To both ends of the driven roller 7, friction rings 8 are connected to rub against the intermediate transfer belt 1 in a non-rotation manner. The friction rings 8 are fitted on side support members 9.

The side support members 9 are biased in the direction of arrows PT by tension springs (compression springs) 10. Hence, the steering roller 3 also functions as a tension roller that applies tension to the inner peripheral surface of the intermediate transfer belt 1 in the direction of arrows PT. The side support members 9 and a turn plate 11 constitute an angular U-shaped supporting base that supports both end portions of the steering roller 3. The turn plate 11 is supported turnably in a direction of arrow S by a bearing 14 provided on a frame stay 12.

As illustrated in FIG. 3, the frame stay 12 is a member that constitutes a housing of the intermediate transfer unit 102, and is laid between the unit front side plate 103F and the unit rear side plate 103R.

As illustrated in FIG. 6B, the bearing 14 is fixed to the center portion of the frame stay 12 by snap fitting. A steering shaft 15 swaged at one end to the turn plate 11 is rotatably supported by the bearing 14. A thrust stopper 18 fitted on the other end of the steering shaft 15 regulates the movement of the steering shaft 15 in the thrust direction.

As illustrated in FIG. 7, roller shafts 16 are fixed to both ends of the driven roller 7 by press fitting. The roller shafts 16 are rotatably supported by bearing portions provided in the friction rings 8 at both ends. For this reason, when the intermediate transfer belt 1 rotates, the driven roller 7 rotates together with the inner peripheral surface of the intermediate transfer belt 1, but does not frictionally slide thereon.

In contrast, the friction rings 8 at both ends of the steering roller 3 frictionally slide on both end portions of the intermediate transfer belt 1. For this reason, when the intermediate transfer belt 1 laterally deviates, the force for moving the friction ring 8 on the deviating side in the rotating direction becomes greater than the force for moving the opposite friction ring 8 in the rotating direction, and the steering roller 3 autonomously tilts.

As illustrated in FIG. 8A, the width of the intermediate transfer belt 1 is larger than the length of the driven roller 7 in the rotation axis direction, and is smaller than the distance between outer end faces of the friction rings 8. Even when the intermediate transfer belt 1 laterally deviates, it frictionally slides on any one of the friction rings 8. In the process in which the lateral deviation of the intermediate transfer belt 1 converges, at least one of the friction rings 8 always frictionally slides on the intermediate transfer belt 1. The steering roller 3 is tilted by the balance of the sliding resistance between both ends thereof. In contrast, in a comparative example in which the width of the intermediate transfer belt 1 is smaller than the width of the driven roller 7, as illustrated in FIG. 8B, when the intermediate transfer belt 1 laterally deviates, the steering roller 3 does not tilt before the intermediate transfer belt 1 is placed on the friction ring 8. At the time point when the intermediate transfer belt 1 is placed on the friction ring 8, a balance difference is suddenly formed in the sliding resistance between both ends, and a great tilting angle is formed. For this reason, steering is likely to be performed rapidly.

As described above, the steering shaft 15 serving as an example of a support mechanism supports the steering roller 3 tiltably. The steering roller 3 has, at both ends in the rotation axis direction, areas where the rotation resistance of the intermediate transfer belt 1 is higher than in the center portion. For this reason, the steering roller 3 autonomously tilts to steer the intermediate transfer belt 1.

Specifications of Steering Roller

As illustrated in FIG. 7, the friction rings 8 each have a taper shape with a taper angle $\phi$. In the first embodiment, the taper angle $\phi$ is 8°.

A static friction coefficient $\mu$ of the surfaces of the friction rings 8 with respect to the intermediate transfer belt 1 is about 0.3, and is higher than a static friction coefficient $\mu$str of 0.1 of the surface of the driven roller 7 with respect to the intermediate transfer belt 1.

The static friction coefficient is measured using an unillustrated specimen with long sides of 200 mm×short sides of 75 mm, which is cut out so that the long sides extend in the circumferential direction of the intermediate transfer belt 1. The specimen is set on an unillustrated measurement table, a surface of the specimen is clamped by a measuring roller made of the same material as that of the friction rings 8 or the driven roller 7 so that the roller crosses the short sides of the specimen, and a load of 10 N (1 kgf) is applied between the specimen and the measuring roller. The force by which the specimen is pulled in the long-side direction by rotating the measuring roller is measured, and the static friction coefficient is obtained.

As the material of the friction rings 8, a resin material having slidability, such as polyacetal (abbreviation: POM), is used. Conductivity is imparted to the resin material by mixing a conductive filler therein in consideration of adverse electrostatic effect due to frictional charge against the intermediate transfer belt 1.

The intermediate transfer belt 1 is a resin belt having a base layer of polyimide, and has a tensile elastic modulus E of about 18000 N/cm$^2$. A great tensile stress generated in the intermediate transfer belt 1, which has a high tensile elastic modulus E and rarely expands, can be effectively converted into the tilting amount of the steering roller 3 by reducing the friction coefficient $\mu$str of the driven roller 7.

The steering roller 3 autonomously tilts to constantly release distortion of the intermediate transfer belt 1. For this reason, the intermediate transfer belt 1 does not need to be conveyed while keeping receiving an excessive load. As a result, not only autonomous steering control can be achieved, but also fracture and deformation of the intermediate transfer belt 1 can be prevented.

According to the first embodiment, there is no need to control any of the actuator and the motor for steering. Hence, a complicated control algorithm is unnecessary. Electric components, such as the sensor and the actuator, are unnecessary, and this can reduce the component cost and wiring cost.

According to the first embodiment, there is no need to stick, to both end portions of the intermediate transfer belt 1, ribs for regulating lateral deviation. Since the intermediate transfer belt 1 having no ribs is used, the increase in speed of the image forming apparatus is not limited by the ribs. Further, the inspection and management costs relating to sticking of the ribs are unnecessary.

The friction rings 8 do not always need to be fixed such as not to rotate in the rotating direction of the driven roller 7. The friction rings 8 may rotate while exerting a rotation resistance higher than that of the driven roller 7. Further, even in the structure of the comparative example illustrated in FIG. 8B, steering operation utilizing the balance of sliding resistance can be performed in principle.

The material of the intermediate transfer belt 1 is not limited to polyimide. The intermediate transfer belt 1 may be formed of other resin or metal materials as long as the material has an equal tensile elastic modulus and includes a base layer formed of a material that hardly expands. Similarly, the material of the driven roller 7 may be other materials as long as μstr of the material is lower than or equal to μs.

Lateral Deviation at Occurrence of Disturbance

The intermediate transfer unit 102 of the autonomous steering type depends on the frictional force between the friction rings 8 and the intermediate transfer belt 1 for the motive power for tilting the steering roller 3. For this reason, the magnitude of steering torque that can be generated in the steering roller 3 is smaller than in the forced steering system using the actuator and the motor.

In the forced steering system, lateral deviation can be caused to converge in a short time by PID control and PD control. However, in the intermediate transfer unit 102 of the autonomous steering type, lateral deviation does not easily converge in a short time because the steering torque is small.

That is, in the intermediate transfer unit 102 that does not use the actuator and the motor, in a state in which great tensile force is applied to the intermediate transfer belt 1, the force for tilting the steering roller 3 is insufficient, and a sufficient steering angle cannot be obtained. Since the sufficient steering angle cannot be obtained, the time until lateral deviation of the intermediate transfer belt 1 converges is long. Particularly when the tension state of the intermediate transfer belt 1 is changed by the contact of the photoconductive drums 111, a lateral-deviation converging position of the intermediate transfer belt 1, which is defined by the positions and inclinations of a plurality of tension rollers, changes. In addition, since the driving roller 2 also functions as the secondary-transfer inner roller, the frictional force thereof is large, and the driving roller 2 is tilted by the influence of the pressing force of the secondary transfer roller 156. Since the tilt of the driving roller 2 changes with the change in load thereon, the lateral-deviation converging position of the intermediate transfer belt 1 is displaced greatly.

Accordingly, in the first embodiment, the pre-secondary-transfer roller 4 coated with the rubber material is disposed upstream of the driving roller 2 to reduce the amount of lateral deviation and to shorten the time until the lateral deviation converges, as illustrated in FIG. 10.

Pre-Secondary-Transfer Roller

Figure 9:
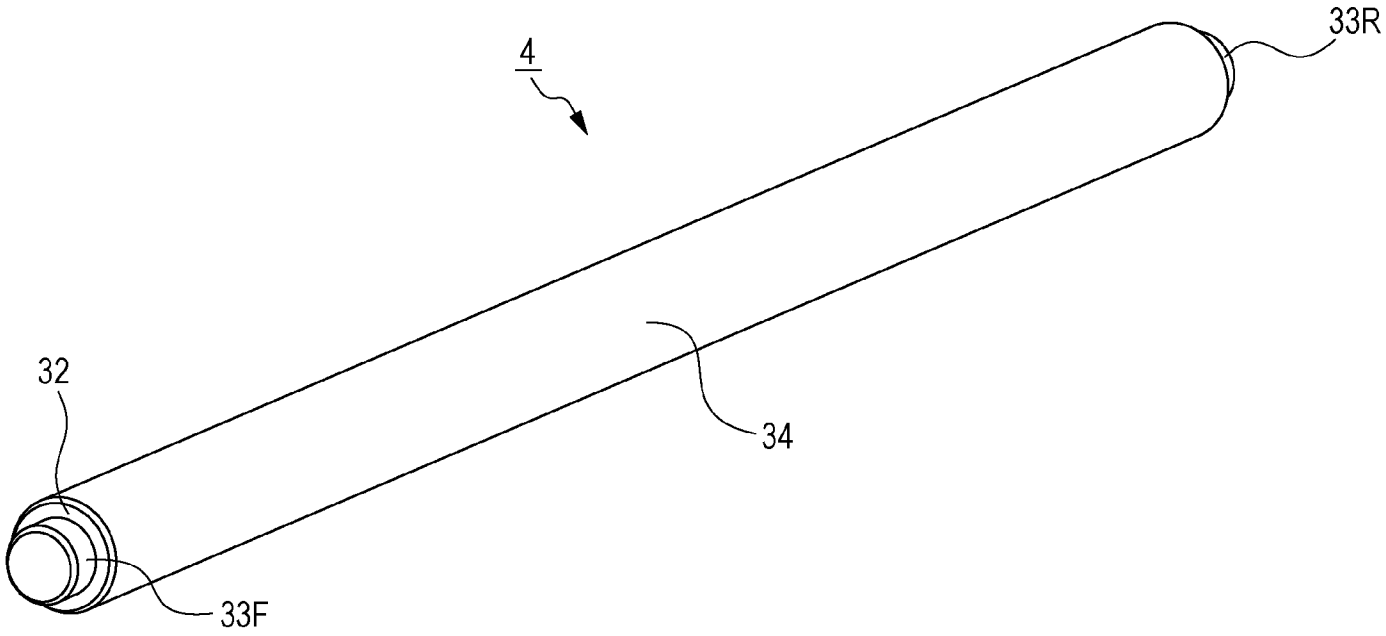
FIG. 9 is an explanatory view illustrating the structure of a pre-secondary-transfer roller.
Figure 11:
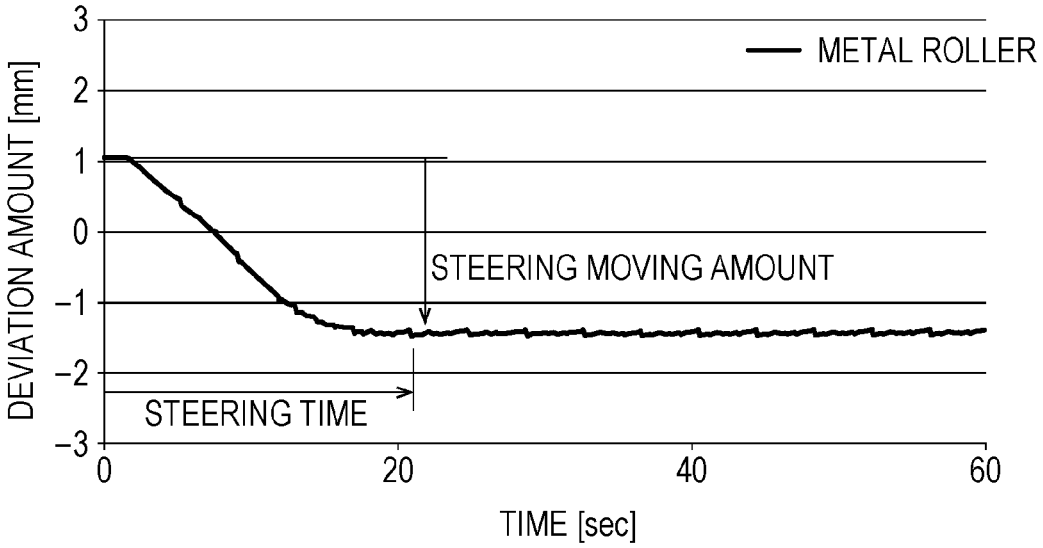
FIG. 11 is an explanatory view showing the lateral-deviation converging time of a pre-secondary-transfer roller in a comparative example.

FIG. 9 is an explanatory view illustrating the structure of the pre-secondary-transfer roller. FIG. 10 is an explanatory view showing the lateral-deviation converging time in a pre-secondary-transfer roller of the example. FIG. 11 is an explanatory view showing the lateral-deviation converging time in a pre-secondary-transfer roller of the comparative example.

As illustrated in FIG. 9, in the pre-secondary-transfer roller 4, a rubber sleeve 34 is joined to an outer peripheral portion of a metal shaft 32. The metal shaft 32 is formed by a stainless steel (SUM) material having an outer diameter of 12 mm. The rubber sleeve 34 in the outer peripheral portion is formed of the same conductive ethylene propylene rubber (EPDM) as that used for the driving roller 2, and has a thickness of 0.5 mm. Two end portions 33F and 33R of the metal shaft 32 are cut to an outer diameter of 9 mm so as to be rotatably supported by the pre-secondary-transfer roller bearings 20, as illustrated in FIG. 4B.

While the static friction coefficient between the intermediate transfer belt 1 and the SUM material is 0.1, the static friction coefficient between the intermediate transfer belt 1 and the conductive EPDM is 1.0 to 1.5. In the pre-secondary-transfer roller 4, the frictional force of the surface of the metal shaft 32 against the intermediate transfer belt 1 is increased by coating the surface of the metal shaft 32 with the rubber material.

The static friction coefficient between the intermediate transfer belt 1 and the SUM material and the static friction coefficient between the intermediate transfer belt 1 and the conductive EPDM are measured with an unillustrated specimen with longs sides of 200 mm×short sides of 75 mm, which is cut out so that the long sides extend in the circumferential direction of the intermediate transfer belt 1. The specimen is set on an unillustrated measurement table, a surface of the specimen is clamped by a measuring roller made of a conductive EPDM or an SUM material so that the roller crosses the short sides of the specimen, and a load of 10 N (1 kgf) is applied between the specimen and the measuring roller. The force by which the specimen is pulled in the long-side direction by rotating the measuring roller is measured, and the static friction coefficient is obtained.

However, the method for increasing the frictional force of the surface of the pre-secondary-transfer roller 4 is not limited to the method for joining the conductive EPDM to the outer peripheral surface of the metal shaft 32. The frictional force may be increased by inserting, sticking, coating, embedding, or applying natural rubber, SBR, silicone rubber, urethane rubber, epichlorohydrin rubber, IR, BR, NBR, or CR.

Between an example in which the front layer of the pre-secondary-transfer roller 4 is formed of rubber and a comparative example in which the pre-secondary-transfer roller 4 is formed by a known metal roller, lateral deviation and the converging process of the lateral deviation when the photoconductive drums 111 transited from the separate state to the contact state were compared. The comparative examples are the same in structure and condition except for the material of the surface of the pre-secondary-transfer roller 4.

As illustrated in FIG. 10, in the example in which the pre-secondary-transfer roller 4 is formed by the rubber-coated roller, the steering moving amount serving as the difference between the initial position of the intermediate transfer belt 1 and the lateral-deviation converging position is small, and the time from arrival at the lateral-deviation converging position to convergence of the lateral deviation is also short. In contrast, as illustrated in FIG. 11, in the comparative example in which the pre-secondary-transfer roller 4 is formed by the metal roller, the steering moving amount serving as the difference between the initial position of the intermediate transfer belt 1 and the lateral-deviation converging position is large, and the time from arrival at the lateral-deviation converging position to convergence of the lateral deviation is also long. In this way, the effect of the material of the surface of the secondary pre-transfer roller 4 could be confirmed.

In the intermediate transfer unit 102, the frictional force of the driving roller 2 is large, and therefore, the driving roller 2 is a great cause of change in the lateral-deviation converging position of the intermediate transfer belt 1. Since the driving roller 2 also functions as the secondary-transfer inner roller in the intermediate transfer unit 102, it is tilted by the pressing force of the secondary transfer roller 156. This is a great cause of the change in lateral-deviation converging position of the intermediate transfer belt 1.

By disposing the pre-secondary-transfer roller 4 having large frictional force upstream of the driving roller 2 in this structure, the positional change of the intermediate transfer belt 1 can be suppressed. Since the pre-secondary-transfer roller 4 having large frictional force is disposed upstream of the driving roller 2 in the intermediate transfer unit 102, the positional change of the intermediate transfer belt 1 can be suppressed by the frictional force of the pre-secondary-transfer roller 4.

Advantages of First Embodiment

In the first embodiment, the pre-secondary-transfer roller 4 includes the rubber material at least on the surface thereof, or the pre-secondary-transfer roller 4 is worked to increase the frictional force of the surface. Alternatively, the static friction coefficient of the pre-secondary-transfer roller 4 is 1.0 or more. The length from the pre-secondary-transfer roller 4 to the driving roller 2 along the intermediate transfer belt 1 is shorter than the length from the steering roller 3 to the pre-secondary-transfer roller 4 along the intermediate transfer belt 1. For this reason, the intermediate transfer belt 1 rarely slips between the pre-secondary-transfer roller 4 and the driving roller 2. This can suppress the occurrence of lateral deviation of the pre-secondary-transfer roller 4.

Since at least the surface of the pre-secondary-transfer roller 4 located upstream of the driving roller 2 is formed of rubber, the lateral moving amount to the converging position of the intermediate transfer belt 1 is reduced, and the steering time required for convergence of the lateral deviation is shortened. Even in an initial operation in which the intermediate transfer unit 102 is first mounted in the apparatus main body, the moving amount until the lateral deviation of the intermediate transfer belt 1 converges is reduced, and the steering time until the lateral deviation converges is shortened. Thus, when image formation is carried out before the lateral deviation due to steering converges, alignment errors of color toner images resulting from the lateral deviation of the intermediate transfer belt 1 are reduced.

Thus, when image formation starts while the intermediate transfer belt 1 is laterally deviating with steering, color misregistration of an output image is reduced. Alternatively, when image formation is on standby until lateral deviation due to steering converges, the start time of the image formation can be brought forward. Since lateral deviation of the intermediate transfer belt 1 is suppressed even when great disturbance acts on the driving force of the driving roller 2, the margin for disturbance with respect to overdisplacement of the intermediate transfer belt 1 can be improved.

In general, the belt member stretched by a plurality of tension rollers deviates toward any one end portion during driving owing to the outer diameter accuracies of the rollers and the alignment accuracy among the rollers. By disposing the idler roller having a high friction resistance on the upstream side of the driving roller, a stable stretch surface of the belt member is formed between the driving roller and the idler roller. This can reduce the belt deviation amount caused in the steering roller. When the belt deviation amount caused in the steering roller is reduced, the tilting angle set for the steering roller for converging lateral deviation can be decreased.

Other Embodiments

In the above-described first embodiment, the photoconductive drums 111 separate from the intermediate transfer belt 1. However, even in an embodiment in which the photoconductive drums 111 do not separate from the intermediate transfer belt 1, the image forming apparatus of the present invention can be carried out between a unit assembled state of the intermediate transfer unit 102 and a state mounted in the apparatus main body.

In the above-described first embodiment, the image forming apparatus adopts the tandem intermediate transfer system. However, the image forming apparatus of the present invention can also be carried out by other electrophotographic image forming apparatuses (for example, a printer, a copying machine, a facsimile apparatus, and a printing machine).

In the above-described first embodiment, the belt conveying device is the intermediate transfer belt. However, the belt conveying device of the present invention can also be carried out by a belt-heating or belt-conveying fixing device, a recording-medium conveying belt, and a transfer belt.

In the above-described first embodiment, the driving roller 2 also functions as the secondary-transfer counter roller. However, the belt conveying device of the present invention can also be carried out in an embodiment in which the driving roller 2 is a member independent of the secondary-transfer counter roller.

In the above-described first embodiment, the steering mechanism of the autonomous steering type is adopted. However, the belt conveying device of the present invention can also be carried out by an embodiment adopting a steering mechanism of a forced steering type that tilts or thrush-moves the steering roller by using an actuator and a motor.

In the first embodiment, coating with the rubber sheet is adopted as working for increasing the static friction coefficient of the surface of the pre-secondary-transfer roller 4. However, the static friction coefficient of the surface can be increased by other various working methods. Working for increasing the contact pressure by subjecting the surface to, for example, spline machining, ring-groove machining, or coating with friction particles can also adopted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-053229, filed Mar. 17, 2014, which is hereby incorporated by reference herein in its entirety.

What is claimed is:

1. An image forming apparatus comprising:

a plurality of photoconductive drums;

a plurality of toner-image forming units configured to form a toner image onto each of the plurality of photoconductive drums;

a belt configured to carry the toner images, wherein each toner image is electrostatically transferred from a photoconductive drum at one of a plurality of first transfer portions;

a plurality of first transfer rollers configured to transfer the toner images on the photoconductive drums toward the belt, wherein the plurality of first transfer rollers are configured to form the plurality of first transfer portions;

a driving roller configured to stretch the belt and to apply driving force to the belt;

a second transfer roller disposed at a position opposed to the driving roller with the belt being disposed therebetween and configured to form a second transfer portion at which the toner images formed on the belt are transferred onto a recording medium;

a steering roller disposed downstream of the driving roller and upstream of the plurality of first transfer portions in a moving direction of the belt and configured to stretch the belt and to be tilted to move a position of the belt in a widthwise direction intersecting the moving direction of the belt, wherein the steering roller includes a rotating portion and a non-rotating portion, wherein the rotating portion rotates along with the movement of the belt in a center portion in the widthwise direction, and wherein the non-rotating portion frictionally slides on an inner surface of the belt with the movement of the belt at each of both ends of the rotating portion;

a contact and separation mechanism configured to bring the belt and the plurality of photoconductive drums into and out of contact with each other; and a driven roller disposed downstream of the plurality of first transfer portions and upstream of the driving roller in the moving direction of the belt, wherein the driven roller includes a rubber material at least on a surface of the driven roller, and is configured to stretch the belt and to be rotated with movement of the belt, wherein a static friction coefficient of the surface of the driving roller with respect to the belt is not less than 1.0 and not more than 1.5, and wherein a static friction coefficient of the surface of the driven roller with respect to the belt is not less than 1.0 and not more than 1.5.

2. The image forming apparatus according to claim 1, wherein the driven roller is disposed at a position adjacent to the plurality of first transfer portions in the moving direction of the belt.

3. The image forming apparatus according to claim 1, wherein the driven roller is disposed at a position adjacent to the driving roller in the moving direction of the belt.

4. The image forming apparatus according to claim 1, wherein a length from the driven roller to the driving roller along the belt is shorter than a length from the steering roller to the driven roller along the belt.

5. The image forming apparatus according to claim 1, wherein the driven roller is worked to increase a frictional force of the surface of the driven roller.

* * * * *